US006663538B2

(12) United States Patent
Yoon

(10) Patent No.: US 6,663,538 B2
(45) Date of Patent: Dec. 16, 2003

(54) SAFETY TRAMPOLINE

(76) Inventor: Jung-Ho Yoon, SinDoRim Dae-Rim Apartment 102 B/D, R.No. 1501, SinDoRim-Dong, GuRo-Gu, Seoul (KR)

( * ) Notice: Subject to any disclaimer, the term of this patent is extended or adjusted under 35 U.S.C. 154(b) by 21 days.

(21) Appl. No.: 10/032,085

(22) Filed: Dec. 21, 2001

(65) Prior Publication Data

US 2002/0098948 A1 Jul. 25, 2002

(30) Foreign Application Priority Data

Dec. 26, 2000 (KR) ..... 2000-86459

(51) Int. Cl.[7] ..... A63B 5/11
(52) U.S. Cl. ..... 482/27; 482/28; 482/29
(58) Field of Search ..... 482/27–29, 23; 5/186.1, 187, 188

(56) References Cited

U.S. PATENT DOCUMENTS 952,871 A * 3/1910 Browder ..... 182/139
1,738,411 A * 12/1929 Welch ..... 5/655
3,129,740 A * 4/1964 Nourse et al. ..... 206/521
4,037,834 A * 7/1977 Oaks ..... 482/27
4,576,375 A * 3/1986 Roberts ..... 482/27
4,880,226 A * 11/1989 Krantz ..... 482/71
5,299,989 A * 4/1994 Boyd et al. ..... 482/27
5,810,695 A * 9/1998 Sass ..... 482/27
6,135,922 A * 10/2000 Nissen ..... 482/27
6,261,207 B1 * 7/2001 Publicover et al. ..... 482/27
6,560,795 B2 * 5/2003 Hsia ..... 5/186.1

* cited by examiner

*Primary Examiner*—Nicholas D. Lucchesi
*Assistant Examiner*—Fenn C Mathew

(57) ABSTRACT

A safety trampoline is described herein. The trampoline comprises a generally circular inner canvas, a plurality of inner plane springs distributed about the perimeter of the inner canvas. The trampoline also comprises a generally circular outer canvas having a hole in its center substantially the same diameter as the perimeter of the inner canvas. The trampoline further comprises a plurality of outer plane springs distributed about the perimeter of the outer canvas and a plurality of binding ropes for attaching the plurality of inner plane springs to the inner canvas and the outer canvas, and for attaching the plurality of outer plane springs to the outer canvas.

4 Claims, 6 Drawing Sheets

SAFETY TRAMPOLINE

RELATED APPLICATIONS

This application claims priority to pending Korean Patent Application No. 4-1998-054524-5 filed on Dec. 29, 2000.

BACKGROUND OF THE INVENTION

1. Field of the Invention

The present invention relates to the field of trampolines.

2. Description of the Related Art

Trampolines are commonly used by people of all ages including men and women. Current trampolines utilize coil springs around their perimeter to provide the resilient function, leaving a space between the perimeter support frame and the outer edge of the canvas that provides the springy surface of the trampoline. The space that exists in the current trampoline can be hazardous as a person's legs, hands or body can fall in-between the canvas platform area of the trampoline and the supporting perimeter of the trampoline, thereby causing injury to the user. Furthermore, the use of the coiled springs as the elastic mechanism in the current trampolines is also a problem because of their rapid loss of elasticity. What is needed is a trampoline that does not contain a hazardous gap between the support frame around the perimeter of the trampoline and the perimeter of the canvas surface of the trampoline. What is also needed is a trampoline having another method of retaining the elasticity required of a trampoline other than the current coiled springs that are utilized in today's trampolines.

SUMMARY OF THE INVENTION

A safety trampoline is described herein. The trampoline comprises a generally circular inner canvas, a plurality of inner plane springs distributed about the perimeter of the inner canvas. The trampoline also comprises a generally circular outer canvas having a hole in its center substantially the same diameter as the perimeter of the inner canvas. The trampoline further comprises a plurality of outer plane springs distributed about the perimeter of the outer canvas and a plurality of binding ropes for attaching the plurality of inner plane springs to the inner canvas and the outer canvas, and for attaching the plurality of outer plane springs to the outer canvas.

BRIEF DESCRIPTION OF THE DRAWINGS

FIG. 3 illustrates one embodiment of the plane springs 10, 20 adapted to flex and provide elasticity to the trampoline. Alternate shapes of plane springs 10, 20 may be used as well. FIG. 3 also illustrates an embodiment of elements 25 that connect the bottom of the plane springs 10, 20 to form a solid base.

FIG. 4 illustrates the relationship of the inner plane springs 10 and the outer plane springs 20 as well as the connecting elements 25 along the bottoms of the springs that form a stable base. FIG. 4 also illustrates the round connecting rings (item 70 of FIG. 6*a* below) at the tops of the plane springs 10, 20.

DETAILED DESCRIPTION OF THE PREFERRED EMBODIMENT

Figure 1:
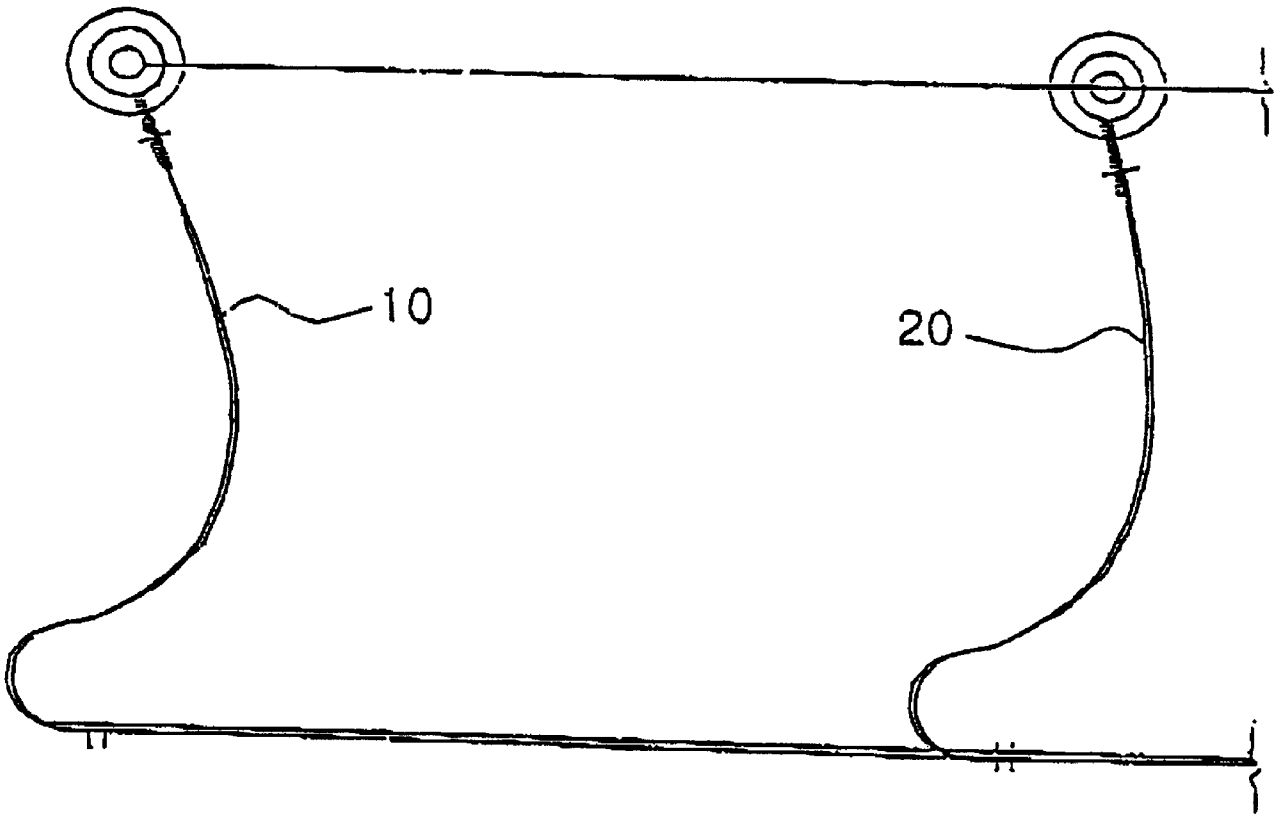
FIG. 1 is a cross-section view of a portion of one embodiment of a trampoline.

Embodiments of a safety trampoline will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Embodiments of a trampoline are described wherein a trampoline may support repeated jumping while maintaining its elasticity, and wherein a canvas mat that forms a jumping surface may be produced utilizing compositions that are utilized in current trampolines. It may be helpful to eliminate the hazardous gap in current trampolines that exists between the outer supporting frame and the trampoline's canvas surface.

A point of difference between embodiments of the trampoline described herein and currently existing trampolines is that the current trampolines contain a gap between the outer support frame and the jumping surface. Embodiments of the current trampoline may have an outer canvas, or jumping surface, between the outer support edge and the canvas jumping surface. Furthermore, an outer canvas, which may be composed of woven nylon or other suitable woven material, may be connected between the support frame and the outer edge of the jumping surface by round connectors described herein. From this it may be apparent that a person would be protected if they fall out of the inner jumping surface by the new canvas that extends between the inner jumping canvas and the support frame perimeter.

The new outer canvas can be connected to and extend beyond the outer edges of the inner canvas. This outer canvas may be connected to the outside edge of the inner canvas by a round connector, which may also provide elasticity. In addition to the elasticity provided by the round connectors, embodiments of the current trampoline may use leaf springs, or plane springs, to provide a higher elastic character than current trampolines. Plane springs, strong resilient "Z" shaped bands, can be suitable in the use of a trampoline and provide significant improvements over existing coil springs in the safety trampoline described herein. The plane springs may be broken up into two sets. A first set of plane springs may exist at the outer edge of the jumping canvas surface while a second outer set of plane springs would exist at the outer edge of the outer canvas, replacing the support frame perimeter of current trampolines.

A unit bond is formed at the joint between the vertical plane of the inner plane springs, the outer edge of the inner canvas surface and the inner edge of the outer canvas surface. A second bond is formed at a connection point of the vertical plane of the outer plane springs and the outer edge of the outer canvas surface. The aforementioned bonds may be round connectors, which will be described later. The round connectors may attach to the tops of the plane springs and also attach the inner and outer canvas surfaces. The upper ends of the plane springs may connect to the bonds with rivets or other suitable fasteners. The design of the plane springs, bonds and fasteners may be dependent upon the weight of the intended users of the trampoline and may be varied accordingly.

In certain embodiments, the upper side of the above-mentioned outer plane springs has formed upon it a connecting ring that is covered with a high-density outer sponge. This sponge fits around the outer side of the connecting ring, while the connecting ring has formed upon it a second high-density inner sponge. The second high-density inner sponge is formed at its edges with projections radially outward. The projections are formed so as to house the outer sponge within them. Therefore, the inner and outer sponges fit over the connecting ring at the top of the outer plane springs. The projecting edges of the inner sponge may be designed so as to tightly hold the outer sponge, thereby forming a closely linked sponge covering for the connecting ring.

Therefore, anytime a person has landed on a sponge covering the connecting ring while moving along the jumping surface of a trampoline, the person may suffer less damage. This is because the foam on the middle spaces that are covering the connecting ring lowers the shock to the person and therefore decreases the damage they suffer.

On the outer part of the inner canvas and the inner part of the outer canvas, there are several binding ropes that allow for coupling by the connecting rings at the top of the inner plane springs. On the connecting rings, there exists a corresponding number of connecting holes to attach the inner and outer canvases using the binding ropes. The connecting holes may be broken up into intake holes and outlet holes, wherein the lower part of the intake holes and outlet holes are formed to allow penetration of the binding ropes in through the intake holes and out through the outlet holes, and to do this repeatedly through the connecting rings so as to provide a proper engagement between the connecting ropes and the connecting rings. In addition, the outer canvas has binding ropes or straps attached to it that extend to the outer connecting rings attached to the top of the outer plane springs. The connecting rings attached to the outer plane springs also have a number of intake and outlet holes corresponding to the binding ropes, and the binding ropes are interwoven and connected through the intake and outlet holes, thereby attaching them to the outer connecting rings. The binding ropes attach to their corresponding canvas surface via any suitable method. The binding ropes may be straps. For example, they may be interwoven into the canvas surfaces, they may be stitched to those surfaces, or they may be riveted to the surfaces.

FIG. 1 is a cross-section view of a portion of one embodiment of a trampoline. FIG. 1 illustrates an outer plane spring 10 and an inner plane spring 20. FIG. 1 also illustrates a portion of the outer canvas or jumping surface connected between the inner and outer band springs by round connectors at the top of each plane spring. There exists two connecting bases along the bottom of each set of plane springs 10, 20 that each connect either the outer set of band springs 10 or the inner set of plane springs 20. There are also band spring connectors extending radially outward from one inner band spring 20 to the corresponding outer band spring 10 outside of it.

Figure 2:
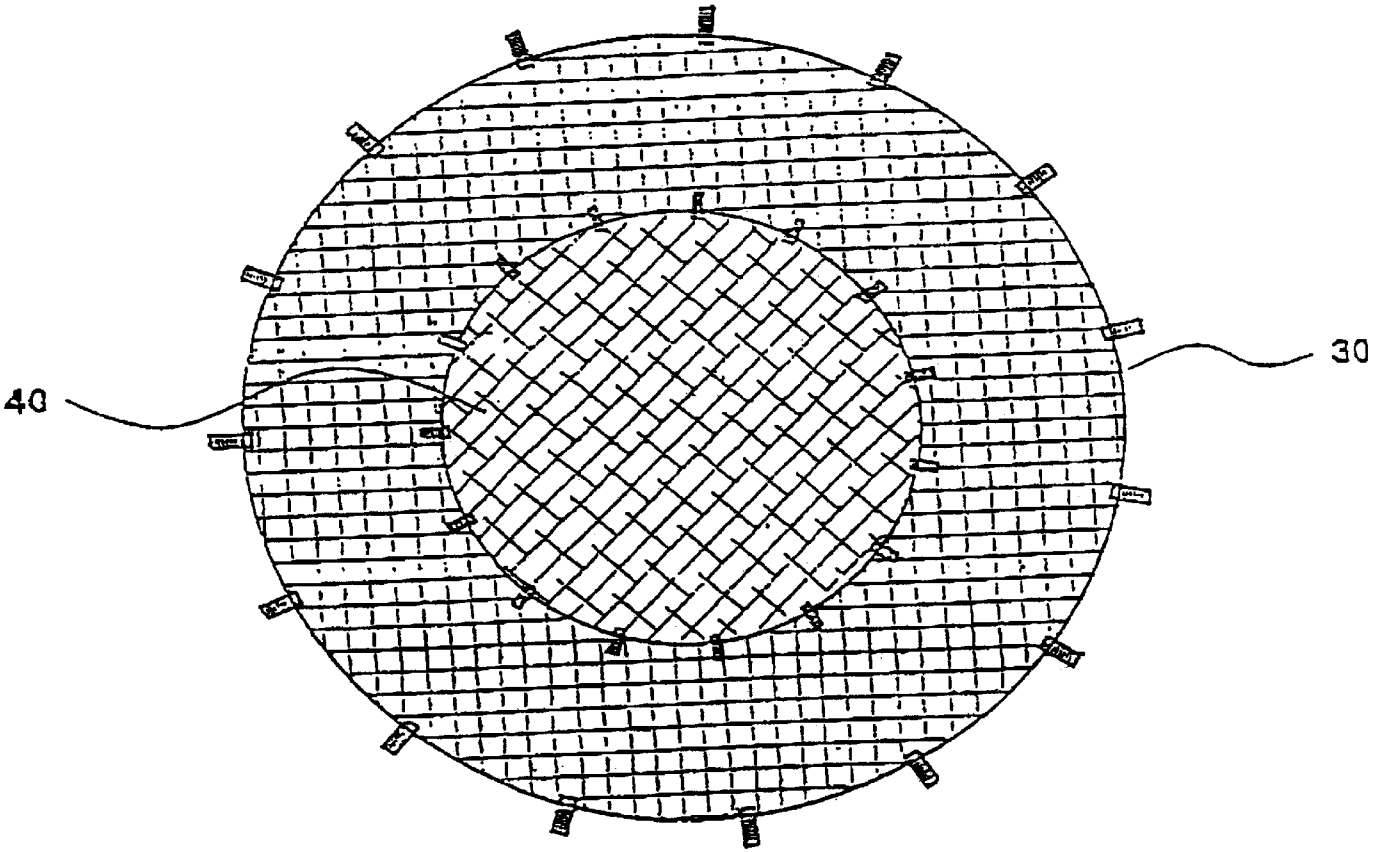
FIG. 2 is a top view of an embodiment of a trampoline.

FIG. 2 is a top view of an embodiment of a trampoline. FIG. 2 illustrates the inner canvas jumping surface 40 and the surrounding outer canvas surface 30. The outer canvas surface 30 provides a safe alternative to the gap between the support frame perimeter and the jumping surface that exists in current trampolines. The tops of the connecting rings may be seen in FIG. 2 disbursed around the perimeter of both the inner canvas surface 40 and the outer canvas surface 30.

Figure 3:
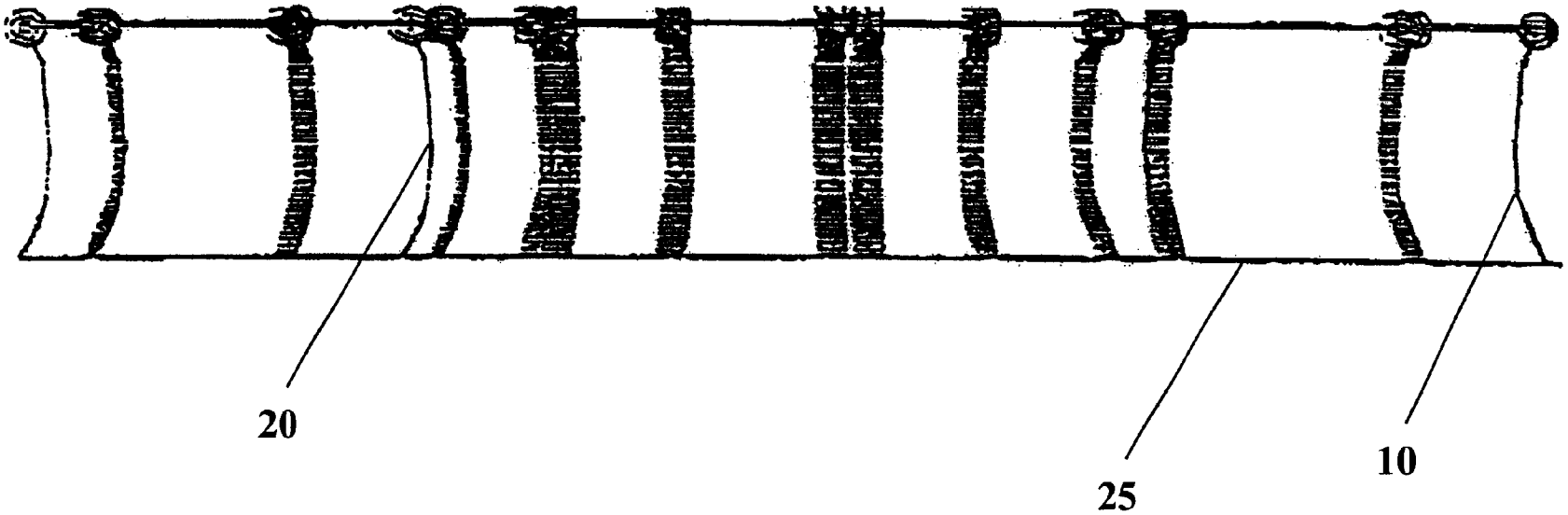
FIG. 3 is a front view of an embodiment of a trampoline.

FIG. 3 is a front view of an embodiment of a trampoline. FIG. 3 illustrates one embodiment of the plane springs adapted to flex and provide elasticity to the trampoline. Alternate shapes of plane springs may be used as well. FIG. 3 also illustrates an embodiment of elements that connect the bottom of the plane springs to form a solid base.

Figure 4:
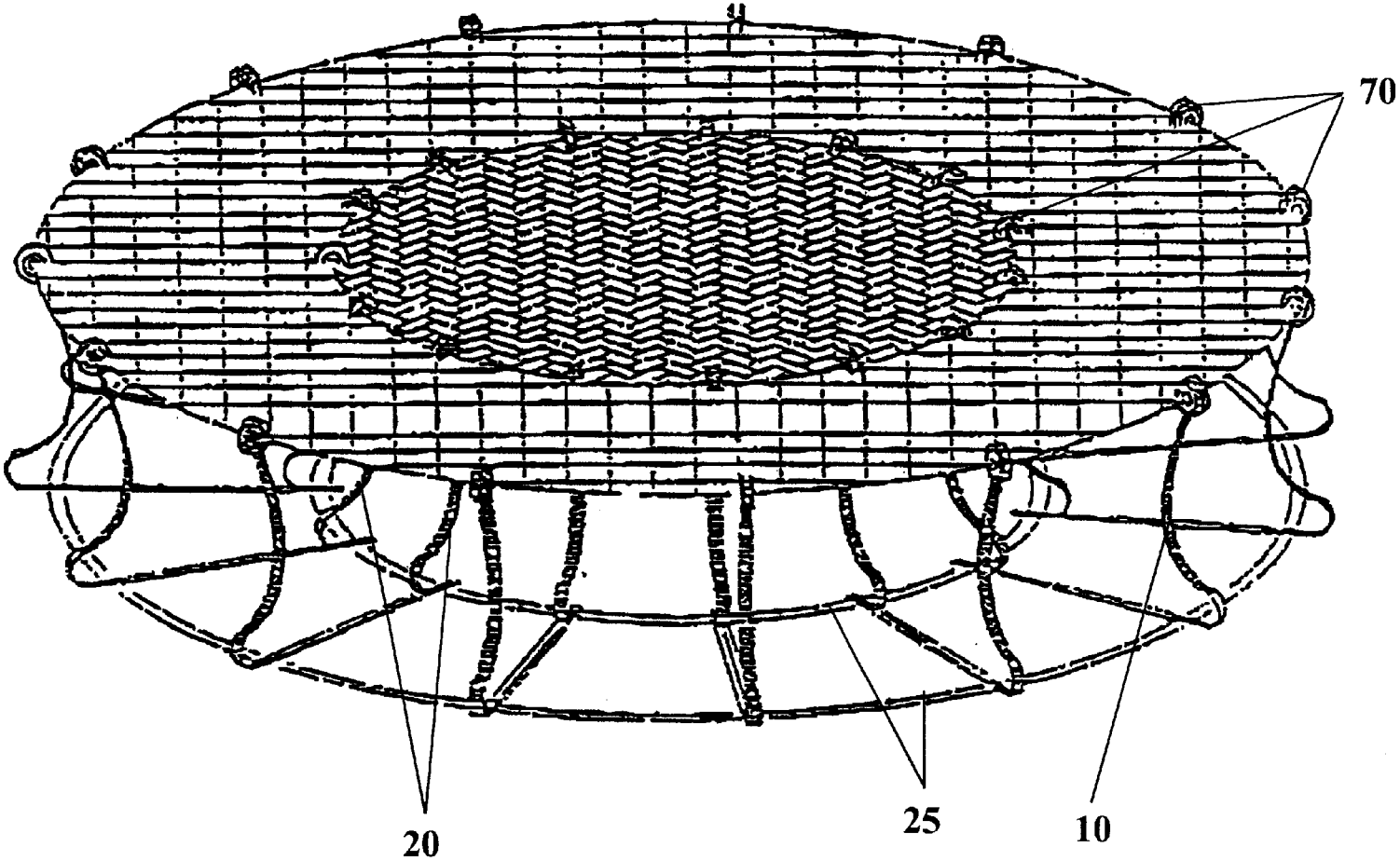
FIG. 4 is an isometric view of an embodiment of a trampoline.

FIG. 4 is an isometric view of an embodiment of a trampoline. FIG. 4 illustrates the relationship of the inner plane springs and the outer plane springs as well as the connecting elements along the bottoms of the springs that form a stable base. FIG. 4 also illustrates the round connecting rings at the tops of the plane springs.

Figure 5B:
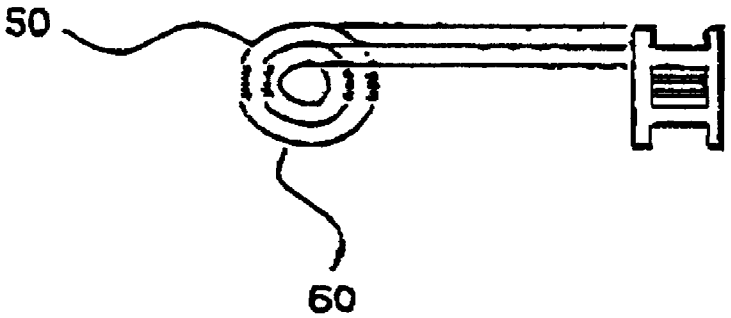
FIG. 5*b* is a combination cutaway side view and front view of the inner sponge 60 and outer sponge 50 detail.
Figure 5A:
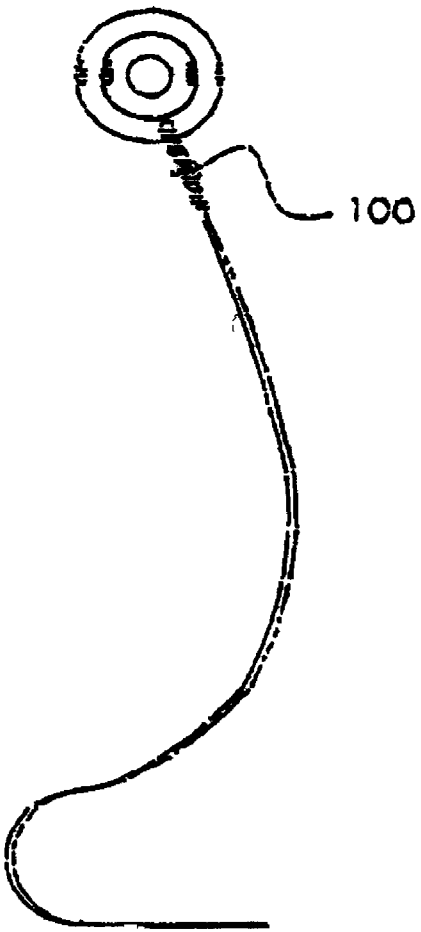
FIG. 5 is a cross-sectional detail view of an embodiment of a trampoline illustrating the connecting rings and the inner and outer sponges.

FIG. 5*a* is a cross-sectional detail view of an embodiment of a trampoline illustrating a connecting ring along with the inner sponge 60 and outer sponge 50. FIG. 5*a* also illustrates one location where a connection hole 100 between the plane spring and the connecting ring may be located. Again, the connecting ring may be attached to the plane spring with a rivet or other suitable fastener. The plane spring illustrated in FIG. 5*a* is one possible embodiment of the plane spring design, a varied "Z" design. Other designs are can be used depending on the use of the trampoline and the desired characteristics of the springs. The plane springs may be made out of any suitable material such as steel, other metal or any other material with the necessary strength and flexibility.

FIG. 5*b* is a combination cutaway side view and front view of the inner sponge 60 and outer sponge 50 detail. The sponges 50, 60 can be various shapes to provide safety to a user and may be made out of any material having the protective qualities. The sponges 50, 60 can also be able to be formed into various shapes.

Figure 6A:
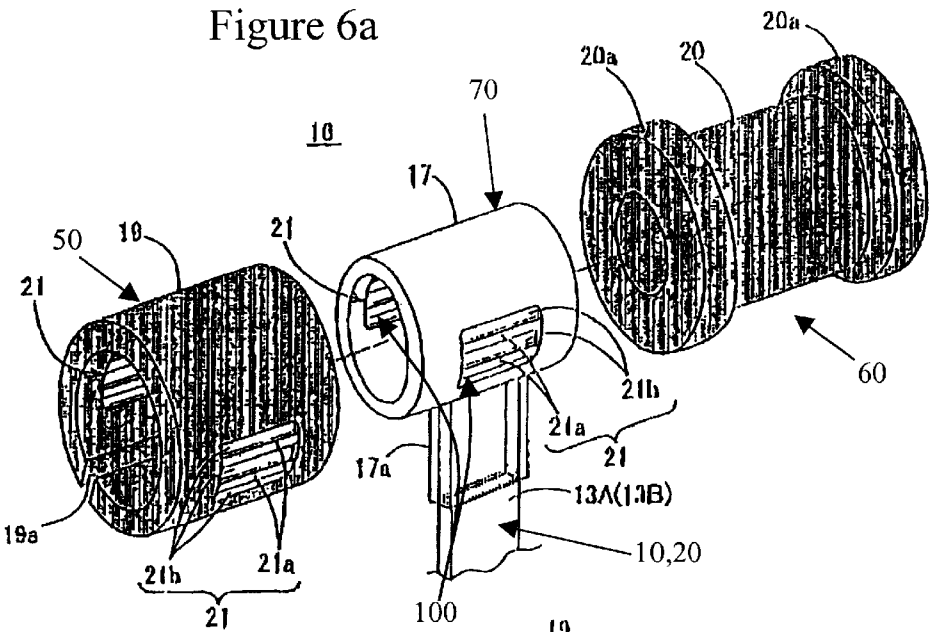
FIG. 6*a* is an exploded component diagram illustrating a combination of the connecting ring and the inner sponge and outer sponge for the connecting straps of an embodiment of a trampoline.

FIG. 6*a* is an exploded component diagram illustrating a combination of the connecting ring 70 and the inner sponge 60 and outer sponge 50 for the connecting straps of an embodiment of a trampoline. FIG. 6*a* also illustrates a connecting ring 70 mounted on a plane spring 10, 20. The sets of connecting holes for the binding rope or strap are also illustrated.

Figure 6B:
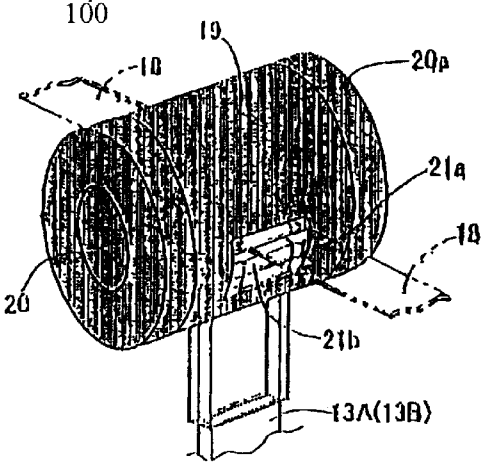
FIG. 6*b* illustrates the assembled connecting ring assembly of one embodiment of a trampoline.

FIG. 6*b* illustrates the assembled connecting ring assembly of one embodiment of a trampoline. This figure illustrates the assembly mounted on the top end of a plane spring. It should be noted that the cylindrical design of the connecting rings illustrated in the embodiments described herein is just one example of a connection of the straps and the tops of the plane springs. Any form of connecting the tops of the plane springs to the binding ropes or straps may be utilized and will meet the intent of this description.

Figure 6C:
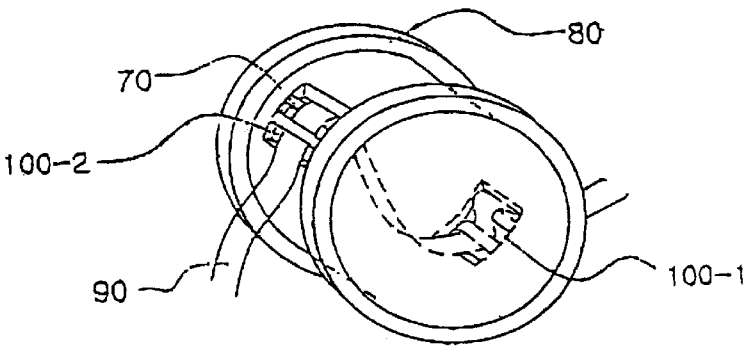
FIG. 6*c* is a view showing hidden lines of a connecting ring assembly of an embodiment of a trampoline.

FIG. 6*c* is a view showing hidden lines of a connecting ring assembly of an embodiment of a trampoline. FIG. 6*c* illustrates the interaction of the binding rope or strap 90 with the inlet holes 100-1 and outlet holes 100-2 that exist in the connecting ring 70. FIG. 6*c* also illustrates the relationship between the projecting edge 80 of the inner sponge and the connecting ring 70.

As previously described, until now trampolines have had extending coil springs from the outside edge of the jumping surface to the support frame, creating a void space between the jumping surface and the support frame. It is this void space which causes many injuries, as a person jumping on the trampoline may fall between the support frame and the canvas jumping surface thereby injuring themselves. Through the embodiments described herein, a safety trampoline may be created wherein instead of falling into a void space between a support frame and a canvas jumping surface, a person would land on a second canvas jumping surface, thereby preventing the significant injury they may have suffered in older trampolines. In addition, as described in previous embodiments, the elasticity of the springs in the safety trampoline may be designed with various weights of users in mind, thereby allowing flexibility in what uses may be made of this trampoline. The inner and outer canvases may add to the elasticity of the trampoline by selecting an elastic material for their construction such as nylon.

The foregoing description details certain embodiments of a safety trampoline. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A trampoline comprising:

a generally circular inner canvas;

a plurality of inner plane springs distributed about the perimeter of the inner canvas;

a generally circular outer canvas having a hole in its center having substantially the same perimeter as the perimeter of the inner canvas;

a plurality of outer plane springs distributed about the perimeter of the outer canvas; and a plurality of binding ropes for attaching the plurality of inner plane springs to the inner canvas and the outer canvas, and for attaching the plurality of outer plane springs to the outer canvas.

2. The trampoline of claim 1, wherein the inner canvas and outer canvas are nylon.

3. The trampoline of claim 1, wherein the plane springs are metal bands in the general shape of a "Z."

4. The trampoline of claim 1, further comprising, a plurality of connecting rings for attaching the binding ropes to the tops of the inner and outer plane springs, wherein each of the connecting rings is covered by a sponge covering.

* * * * *